US005192060A

United States Patent [19]

Novak

[11] Patent Number: 5,192,060

[45] Date of Patent: Mar. 9, 1993

[54] AUXILIARY PRESSURE CLAMP

[76] Inventor: John Novak, 1808 Craig Cir., Rogers, Ark. 72756

[21] Appl. No.: 872,686

[22] Filed: Apr. 20, 1992

[51] Int. Cl.[5] ..... B25B 1/00

[52] U.S. Cl. ..... 269/147; 269/155

[58] Field of Search ..... 269/166–171, 269/155, 156, 147–149, 118

[56] References Cited

U.S. PATENT DOCUMENTS

| | | | |
|---|---|---|---|
| 1,408,301 | 2/1922 | Jeter | 269/147 |
| 2,937,521 | 5/1960 | Savage | 269/156 |
| 4,792,129 | 12/1988 | LePrevost | 269/156 |
| 4,957,257 | 9/1990 | Gonzalez | 269/167 |
| 4,962,918 | 10/1990 | Yang | 269/156 |
| 5,058,870 | 10/1991 | Cetnar | 269/147 |

FOREIGN PATENT DOCUMENTS

| | | | |
|---|---|---|---|
| 535454 | 11/1955 | Italy | 269/156 |

*Primary Examiner*—Robert C. Watson

*Attorney, Agent, or Firm*—Richard L. Miller

[57] ABSTRACT

An auxiliary pressure clamp is provided for a bar clamp structure on an internally threaded sleeve for adjustably engaging an elongated bar of the bar clamp at a right angle thereto. A force-applying screw is threaded into the sleeve and has a handle at another end to rotate the force applying screw within the sleeve. A head will engage with a work place at a right angle to the clamping action of the bar clamp to apply pressure thereto, especially when various parts of the work piece are being glued together, or a veneer is being glued to a surface of a work piece.

2 Claims, 1 Drawing Sheet

AUXILIARY PRESSURE CLAMP

BACKGROUND OF THE INVENTION

The instant invention relates generally to bar clamps and more specifically it relates to an auxiliary pressure clamp.

Numerous bar clamps have been provided in the prior art that are adapted to be indispensable tools for a gluing work pieces when making furniture and built-ins since the pressure they exert are tremendous. For example, U.S. Pat. Nos. 3,499,206 to Quernheim; 3,677,584 to Short and Des. 274,034 to Lacina all are illustrative of such prior art. While these units may be suitable for the particular purpose to which they address, they would not be as suitable for the purpose of the present invention as hereafter described.

SUMMARY OF THE INVENTION

A primary object of the present invention is to provide an auxiliary pressure clamp for a bar clamp that will overcome the shortcomings of the prior art devices.

Another object is to provide an auxiliary pressure clamp for a bar clamp that is adjustably affixed to the elongated bar of a bar clamp to apply forces to a work piece at a right angle to the clamping action of the bar clamp.

An additional object is to provide an auxiliary pressure clamp for a bar clamp that includes a mechanism attached thereto to prevent the accidental removal of the auxiliary pressure clamp from the elongated bar of the bar clamp.

A further object is to provide an auxiliary pressure clamp for a bar clamp that is simple and easy to use.

A still further object is to provide an auxiliary pressure clamp for a bar clamp that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
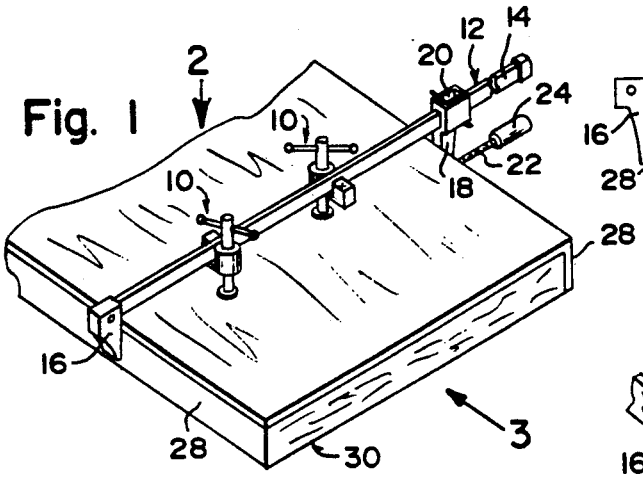
FIG. 1 is a diagrammatic perspective view illustrating the instant invention in use.

Turning now descriptively to the drawings, in which similar reference characters denote similar elements throughout the several views, the Figures illustrate an auxiliary pressure clamp 10 for a bar clamp 12 which has an elongated bar 14, a fixed jaw 16, a sliding head 18 with a multiple pad clutch 20 and an operating screw 22 with a handle 24 at one end and a movable jaw 26 at another end, so as to engage the sides 28 of a work piece 30. The auxiliary pressure clamp 10 consists of an internally threaded sleeve 32 and a structure 34 on the sleeve 32 for adjustably engaging the elongated bar 14 of the bar clamp 12 at a right angle thereto. A force-applying screw 36 is threaded into the sleeve 32. A head 38 is at one end of the force-applying screw 36, and a handle 40 is at the other end of the force-applying screw 36 to rotate the force-applying screw 36 within the sleeve 32. The head 38 will engage with the work piece 30 at a right angle to the clamping action of the bar clamp 12 to apply pressure thereto, especially when various parts of the work piece 30 are being glued together.

The adjustable engaging structure 34 includes an L-shaped member 42 affixed to one side of the sleeve 32, so as to form a slot 44 therebetween, in which the elongated bar 14 of the bar clamp 12 can slideably fit within the slot 44. The L-shaped member 42 has a short arm 46 that is affixed to the one side of the sleeve 32 and a long arm 48 bent upwardly at a right angle to the short arm 46 and extends parallel to the sleeve 32.

The long arm 48 has a threaded hole 50 running longitudinally within its distal end. A optional washer 52 can be provided having a diameter larger than the thickness of the long arm 48. A securement screw 54 can be threaded into the threaded hole 50 in the long arm 48 to retain the washer 52 thereto. This will keep the elongated bar 14 within the slot 44 between the sleeve 32 and the L-shaped member 42 and prevents accidental removal therefrom. One edge of the washer has a flattened facet 56 so that rotating the washer with the facet facing the elongated bar 14, permits the removal of the elongated bar 14, from within the slot 44 between the sleeve 32 and the L-shaped member 42 when so desired without the disassembly of the screw and washer from arm 48.

Figure 3:
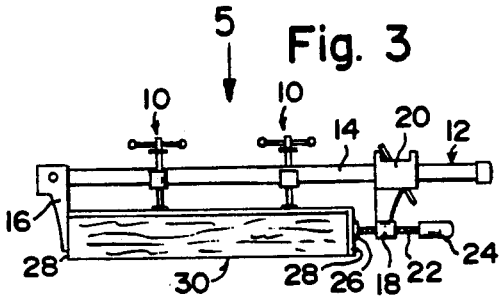
FIG. 3 is a elevational view taken in the direction of arrow 3 in FIG. 1.
Figure 4:
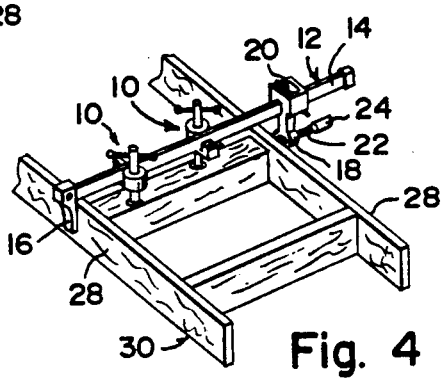
FIG. 4 is a diagrammatic perspective view showing another application of the instant invention in use.
Figure 5:
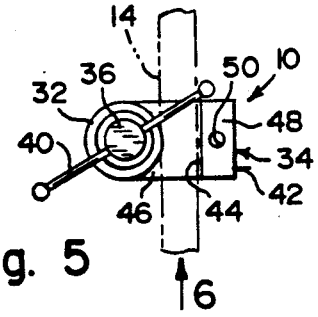
FIG. 5 is an enlarged top view taken in the direction of arrow 5 in FIG. 3 of just the instant invention per se.
Figure 2:
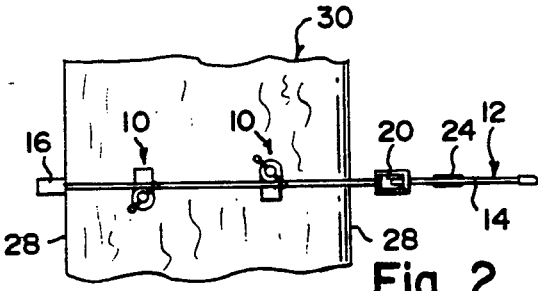
FIG. 2 is a top view taken in the direction of arrow 2 in FIG. 1.
Figure 6:
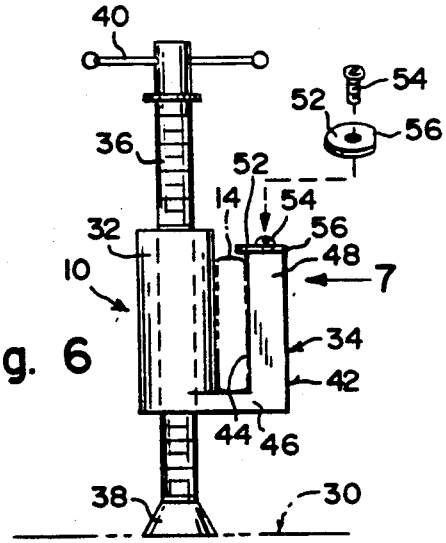
FIG. 6 is a diagrammatic side elevational view taken in the direction of arrow 6 in FIG. 5, and further illustrating a optional securement screw and washer.
Figure 7:
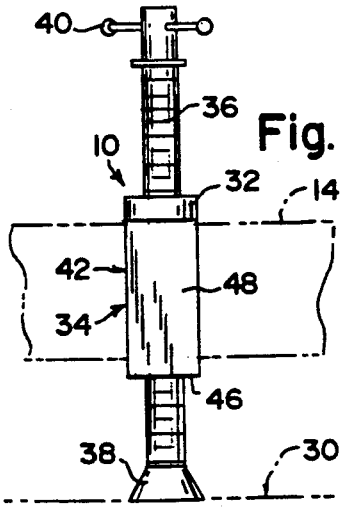
FIG. 7 is a diagrammatic front elevational view taken in the direction of arrow 7 in FIG. 6.

Only one auxiliary pressure clamp 10 is described herein in use with the bar clamp 12. Two are shown in FIGS. 1 through 4, which indicates that more than one can be utilized for various tasks on different work pieces 30. Several clamps 10 are extremely useful when gluing a veneer to a surface.

To use the auxiliary pressure clamp 10 the following steps should be taken:

1. Place the bar clamp 12 over the work piece 30 and clamp it in place, leaving enough space between the elongated bar 14 and the top of the work piece 30.

2. Position the auxiliary pressure clamp 10 onto the elongated bar 14 by fitting the slot 44 up about the elongated bar 14.

3. Rotate the operating slide handle 40, so that the force-applying screw 36 will travel down until the proper pressure is applied onto the top of the work piece 30, that is to be glued at ninety degrees from the clamping action of the bar clamp 12.

While certain novel features of this invention have been shown and described and are pointed out in the annexed claims, it will be understood that various omissions, substitutions and changes in the forms and details of the device illustrated and its operation can be made by those skilled in the art without departing from the spirit of the invention.

What is claimed is:

1. An auxiliary pressure clamp for a bar clamp which has an elongated bar, a fixed jaw, a sliding head with a multiple pad clutch and an operating screw with a handle at one end and a movable jaw at another end, so as to engage the sides of a work piece, said auxiliary pressure clamp comprises:

a) an internally threaded sleeve;

b) means on said sleeve for adjustably engaging the elongated bar of the bar clamp at a right angle thereto, wherein said adjustable engaging means includes an L-shaped member affixed to one side of said sleeve, so as to form a slot therebetween, in which the elongated bar of the bar clamp can slideably fit within the slot, wherein said L-shaped member includes:

I) a short arm that is affixed to the one side of said sleeve; and

II) a long arm bent upwardly at a right angle to said short arm and extending parallel to said sleeve, further including:

i) said long arm having a threaded hole running longitudinally within its distal end;

ii) a washer having a diameter larger than the thickness of said long arm; and iii) a securement screw threaded into said threaded hole in said long arm to retain said washer thereto, so as to keep the elongated bar within the slot between said sleeve and said L-shaped member and prevent accidental removal therefrom;

c) a force-applying screw which is threaded into said sleeve;

d) a head at one end of said force-applying screw; and e) an operating handle at other end of said force-applying screw to rotate said force-applying screw within said sleeve, so that said head will engage with the work piece at a right angle to the clamping action of the bar clamp to apply pressure thereto, especially when various parts of the work piece are being glued together.

2. An auxiliary pressure clamp for a bar clamp as recited in claim 1, wherein said washer has a flattened facet so that rotating the washer with the facet facing the elongated bar, permits the removal of the elongated bar from within the slot between the sleeve and the L-shaped member when so desired without the disassembly of the securement screw and washer from arm.

* * * * *